US009788132B2

(12) United States Patent
Akino

(10) Patent No.: US 9,788,132 B2
(45) Date of Patent: Oct. 10, 2017

(54) NARROW DIRECTIONAL MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 0 days.

(21) Appl. No.: 15/366,591

(22) Filed: Dec. 1, 2016

(65) Prior Publication Data

US 2017/0171680 A1 Jun. 15, 2017

(30) Foreign Application Priority Data

Dec. 15, 2015 (JP) ..... 2015-243790

(51) Int. Cl.
*H04R 29/00* (2006.01)
*H04R 1/04* (2006.01)
*H04R 3/04* (2006.01)

(52) U.S. Cl.
CPC ..... *H04R 29/004* (2013.01); *H04R 1/04* (2013.01); *H04R 3/04* (2013.01); *H04R 2410/07* (2013.01)

(58) Field of Classification Search
CPC ..... H04R 1/342; H04R 19/04; H04R 1/326; H04R 25/65; H04R 1/04; H04R 25/604; H04R 25/658; H04R 9/08; H04R 1/08; H04R 1/1041; H04R 2410/07; H04R 1/1075; H04R 25/50; H04R 31/006; H04R 19/016
See application file for complete search history.

(56) References Cited

U.S. PATENT DOCUMENTS

| | | | | |
|---|---|---|---|---|
| 9,497,538 | B2 * | 11/2016 | Akino | H04R 1/326 |
| 9,693,151 | B2 * | 6/2017 | Akino | H04R 1/38 |
| 2008/0101637 | A1 * | 5/2008 | Ho | H04R 25/00 381/328 |
| 2013/0216084 | A1 * | 8/2013 | Akino | H04R 1/326 381/346 |

FOREIGN PATENT DOCUMENTS

JP 4000217 B2 10/2007

* cited by examiner

*Primary Examiner* — Mohammad Islam
(74) *Attorney, Agent, or Firm* — Manabu Kanesaka

(57) ABSTRACT

A narrow directional microphone includes a unit case having a front end portion to which a microphone unit is mounted, and a side surface functioning as a grip, an acoustic tube formed of resin material in a tubular shape, covering the microphone unit, and attached to the front end portion of the unit case such that the microphone unit is positioned to an inner bottom portion of the acoustic tube, a piezoelectric film that is arranged in at least one part of the acoustic tube, and that generates a detection output based on a mechanical deformation of the acoustic tube, and an output signal processing unit including an attenuation circuit that attenuates an audio signal from the microphone unit with the detection output from the piezoelectric film and sends the attenuated audio signal to a signal output unit.

8 Claims, 3 Drawing Sheets

NARROW DIRECTIONAL MICROPHONE

RELATED APPLICATIONS

The present application is based on, and claims priority from, Japanese Application No. JP2015-243790 filed Dec. 15, 2015, the disclosure of which is hereby incorporated by reference herein in its entirety.

BACKGROUND OF THE INVENTION

Field of the Invention

The present invention relates to a narrow directional microphone using an acoustic tube, and especially relates to a narrow directional microphone that can decrease a wind noise and a vibration noise.

Description of the Related Art

A narrow directional microphone using a long and narrow acoustic tube and having a microphone unit arranged in an inner bottom portion of the acoustic tube has been known, and this narrow directional microphone has high sensitivity characteristics for a sound wave entering from a front end portion in an axial direction of the acoustic tube.

That is, in the acoustic tube, the front end portion thereof is open, for example, slit-like sound wave introduction ports are formed in a side surface, and an acoustic resistance material is stuck to the sound wave introduction port in the side surface. With this configuration, among sound waves from directions other than the axial direction of the acoustic tube, a sound wave entering from the front end portion of the acoustic tube and a sound wave entering through the sound wave introduction port in the side surface of the acoustic tube have a time difference, and interfere with and cancel each other.

As a result, a narrow directional microphone having high sensitivity only for the sound wave from the front end portion in the axial direction of the acoustic tube can be obtained, and this is also called a shotgun microphone.

In the narrow directional microphone using the acoustic tube, since the microphone unit is positioned in the inner bottom portion of the acoustic tube, a distance between a front acoustic terminal and a rear acoustic terminal of the microphone unit becomes long, and thus a wind noise increases.

Further, a vibration noise increases with the mass of the air in the acoustic tube in the narrow directional microphone using the acoustic tube, and thus there is a technical problem that the vibration noise becomes larger as the acoustic tube is longer.

Since these wind noise and vibration noise are mainly generated in a low frequency band, measures are considered to include a low frequency cut filter that removes a low frequency range component from an audio signal from the microphone unit, and to insert the low frequency cut filter into a transmission path of the signal from the microphone unit by a manual switch operation, when the wind noise and the vibration noise are anticipated to be large.

Meanwhile, the applicant of the present application has proposed a microphone including means for decreasing a vibration noise, and which is disclosed in Japanese Patent No. 4000217 B2 (a patent document 1).

According to the microphone disclosed in the document 1, a vibration detection unit using a piezoelectric element is included in a microphone case, and the microphone operates to attenuate and output an audio signal from the microphone unit based on a vibration detection signal from the vibration detection unit.

Accordingly, a vibration noise can be reduced which, for example, is generated on the basis of a relative speed between a vibration system including a diaphragm and a fixed portion such as a magnetic circuit.

SUMMARY OF THE INVENTION

By the way, in a case of the narrow directional microphone using the acoustic tube described above, a specific wind noise is also generated in addition to the vibration noise, and it is difficult to suppress the wind noise by the means for decreasing a vibration noise, disclosed in the patent document No. 4000217 B2.

Therefore, an objective of the present invention is to provide a narrow directional microphone that can suppress, using a single sensor, both of the wind noise and the vibration noise especially generated in the narrow directional microphone using an acoustic tube.

A preferred embodiment of a narrow directional microphone of the present invention to solve the above problem includes a unit case having a front end portion to which a microphone unit is mounted, a side surface having a function of a grip; an acoustic tube, covering the microphone unit, and attached to the front end portion of the unit case such that the microphone unit is positioned to an inner bottom portion of the acoustic tube; a detection unit that detects mechanical deformation of the acoustic tube; and an output signal processing unit including an attenuation circuit that attenuates an audio signal from the microphone unit based on the detection output from the detection unit and sends the attenuated audio signal to a signal output unit. In this case, a piezoelectric film, being arranged at least on one part of the acoustic tube, may be used as the detection unit. Alternatively, the acoustic tube is formed of a piezoelectric film and the piezoelectric film serves as the detection unit. Further the acoustic tube is preferably flexible.

Then, the output signal processing unit favorably includes the attenuation circuit with a low frequency cut filter that attenuates a low frequency range component in the audio signal from the microphone unit on the basis of the detection output from the detection unit.

The low frequency cut filter can vary a cut-off frequency in a low frequency range, according to a value of the detection output.

Further, in the output signal processing unit, a configuration including the attenuation circuit that attenuates a level of the audio signal from the microphone unit based on the detection output can be employed.

The attenuation circuit can attenuate the level of the entire band of the audio signal according to a value of the detection output.

According to the narrow directional microphone according to the present invention, the acoustic tube is relatively displaced with respect to the grip when vibration is applied to the grip formed on the side surface of the unit case. Meanwhile, the acoustic tube is displaced by received wind when the wind pressure is applied to the acoustic tube.

Therefore, a deformation occurs in the acoustic tube in both cases when vibration is applied to the grip and when wind is applied to the acoustic tube, and thus a detection output is generated in the piezoelectric film formed of a polyvinylidene fluoride resin, for example.

The detection output is supplied to the output signal processing unit, and the output signal processing unit operates to attenuate the level of the audio signal from the microphone unit or attenuate the low frequency range component. Accordingly, a narrow directional microphone that can suppress both of a wind noise and a vibration noise can be provided.

DESCRIPTION OF THE PREFERRED EMBODIMENTS

Figure 1:
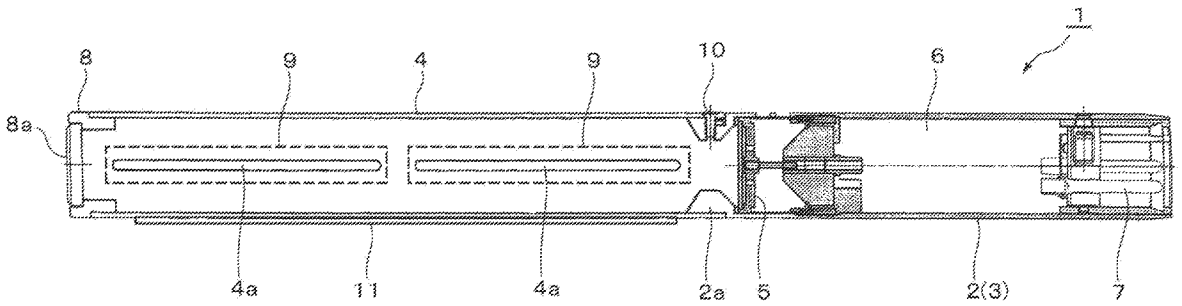
FIG. 1 is a central sectional view of a narrow directional microphone according to a first embodiment of the present invention.

A narrow directional microphone according to the present invention will be described on the basis of embodiments illustrated in the drawings. FIG. 1 illustrates a first embodiment of a narrow directional microphone. An outer wall of a narrow directional microphone 1 illustrated in FIG. 1 is formed of a unit case 2 made of aluminum material, for example, and having an outer surface functioning as a grip 3, and an acoustic tube 4 formed of resin material in a tubular shape and attached to a front end portion of the unit case 2.

That is, the unit case 2 and the acoustic tube 4 have nearly the same outer diameter dimension and are coaxially combined, so that the entire body forms a long cylindrical shape.

A microphone unit 5 is attached to a front end portion in the unit case 2, and therefore the microphone unit 5 is arranged in an inner bottom portion of the acoustic tube 4 attached to the unit case 2.

The microphone unit 5 is formed of a condenser microphone unit. An impedance conversion circuit that converts impedance of an output from the condenser microphone unit, and an output signal processing unit described below that processes an output signal from the impedance conversion circuit are mounted on a circuit board 6 accommodated in the unit case 2.

Then, an output signal from the output signal processing unit mounted on the circuit board 6 is outputted to a three-pin type output connector 7 arranged in a rear end portion of the unit case 2.

Meanwhile, the acoustic tube 4 is formed of resin material such as a fluororesin, and its front end portion is open, and a cover holder 8 including a mesh cover 8*a* in a central portion is fit into and attached to this front-end open portion.

A plurality of slit-shaped openings 4*a* is formed on a side surface of the acoustic tube 4, and an acoustic resistance material 9 formed into a strip shape is stuck to a circumferential side surface of the acoustic tube 4 in order to block the openings 4*a* from an outside.

Further, in the present embodiment, a piezoelectric film 11 is stuck on an outer wall of the acoustic tube 4 along an axial direction. As the piezoelectric film 11, a film formed of polyvinylidene fluoride (PVDF) resin is preferably used, which has coated electrodes on both surfaces thereof.

Then, a rear end portion of the acoustic tube 4 is attached with a plurality of screws 10 to an annularly protruding attaching portion 2*a* formed in the front end portion of the unit case 2. Note that, in this example, three screws including the illustrated screw 10 are screwed into the attaching portion 2*a* in a circumferential direction at equal intervals, and support the acoustic tube 4.

According to the narrow directional microphone 1 illustrated in FIG. 1, the acoustic tube 4 attached to the front end portion of the unit case 2 is formed of resin material in a tubular shape, and thus has flexibility specific to the resin material. Further, the piezoelectric film 11 is stuck on the outer wall of the acoustic tube 4 along the axial direction, and thus, in a case where vibration is applied to the grip 3 of the unit case 2, or in a case where wind is applied to the acoustic tube 4, a detection output can be obtained from the piezoelectric film 11 in accordance with a deformation of the acoustic tube 4.

That is, the piezoelectric film constitutes a detection unit (referred to the same reference number as the piezoelectric film 11) that detects mechanical deformation of the acoustic tube 4.

Figure 2:
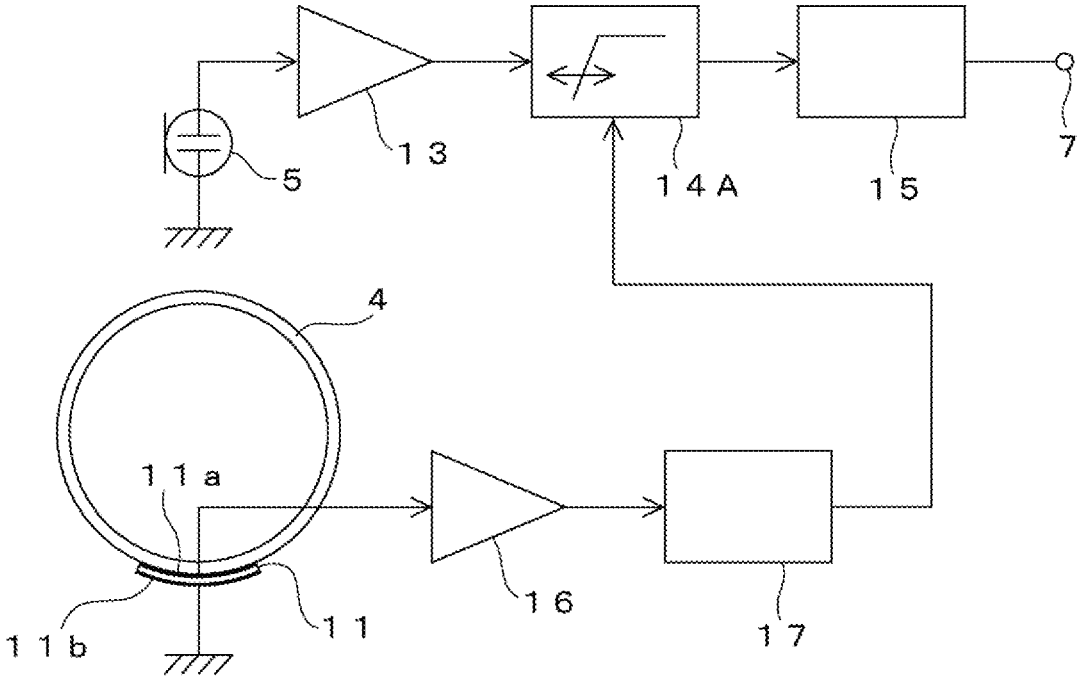
FIG. 2 is mainly a block diagram of a signal processing unit mounted in the microphone illustrated in FIG. 1.

FIG. 2 is a block diagram illustrating an example of an output signal processing unit that can suppress a vibration noise and a wind noise generated in the narrow directional microphone 1, using the detection output from the detection unit composed of the piezoelectric film 11.

Note that the output signal processing unit illustrated in FIG. 2 is mounted on the circuit board 6 accommodated in the unit case 2 in the narrow directional microphone 1.

A first impedance conversion circuit 13 using a field effect transistor FET and the like is connected to the microphone unit 5 illustrated in FIG. 2, and an audio signal obtained by the first impedance conversion circuit 13 is supplied to an attenuation circuit 14A with a low frequency cut filter that selectively attenuates a low frequency range component of the audio signal.

Then, an output from the attenuation circuit 14A with a low frequency cut filter is supplied to the output connector 7 that functions as a signal output unit after amplified by a signal amplification circuit 15, and is outputted as an audio output signal of the microphone 1 through the output connector 7.

Meanwhile, the detection output from the piezoelectric film 11, stuck to the outer wall of the acoustic tube 4 along the axial direction, is supplied to a second impedance conversion circuit 16. That is, as illustrated in FIG. 2, an electrode 11*b* formed on an outer surface of the detection unit formed of a piezoelectric film 11 stuck to the acoustic tube 4 is connected to a reference potential point (ground) of the circuit, and an electrode 11*a* formed on an inside of the piezoelectric film 11 is connected to the second impedance conversion circuit 16.

Then, the detection output of the piezoelectric film 11 (the detection unit) from the second impedance conversion circuit 16 is supplied to a control circuit 17. When a value of the detection output by the second impedance conversion circuit 16 exceeds a predetermined threshold, the control circuit 17 functions to send a control signal to the attenuation circuit 14A having a low frequency cut filter and to attenuate a low frequency range component of the audio signal from the microphone unit 5, which is obtained by the first impedance conversion circuit 13.

The attenuation function of the low frequency range component is carried out in both cases when the acoustic tube 4 is relatively displaced with respect to the grip 3 by vibration applied to the grip 3 of the unit case 2, and when a deformation occurs in the acoustic tube 4 by a wind pressure applied to the acoustic tube 4.

Accordingly, a narrow directional microphone that can suppress both of the vibration noise output from the microphone unit 5 and the wind noise can be provided.

Note that the description has been given such that the suppression operation of the vibration noise and the wind noise is carried out when the detection output from the piezoelectric film 11 (the detection unit) exceeds a predetermined threshold. However, a similar function and effect can be obtained when a low cut off frequency can be made variable according to the value of the detection output from the piezoelectric film 11 (the detection unit).

In this case, it is desirable to set so that the low cut off frequency shifts to a higher frequency side as a level of the detection output from the piezoelectric film 11 (the detection unit) becomes higher, that is, the vibration noise and the wind noise become larger.

Figure 3:
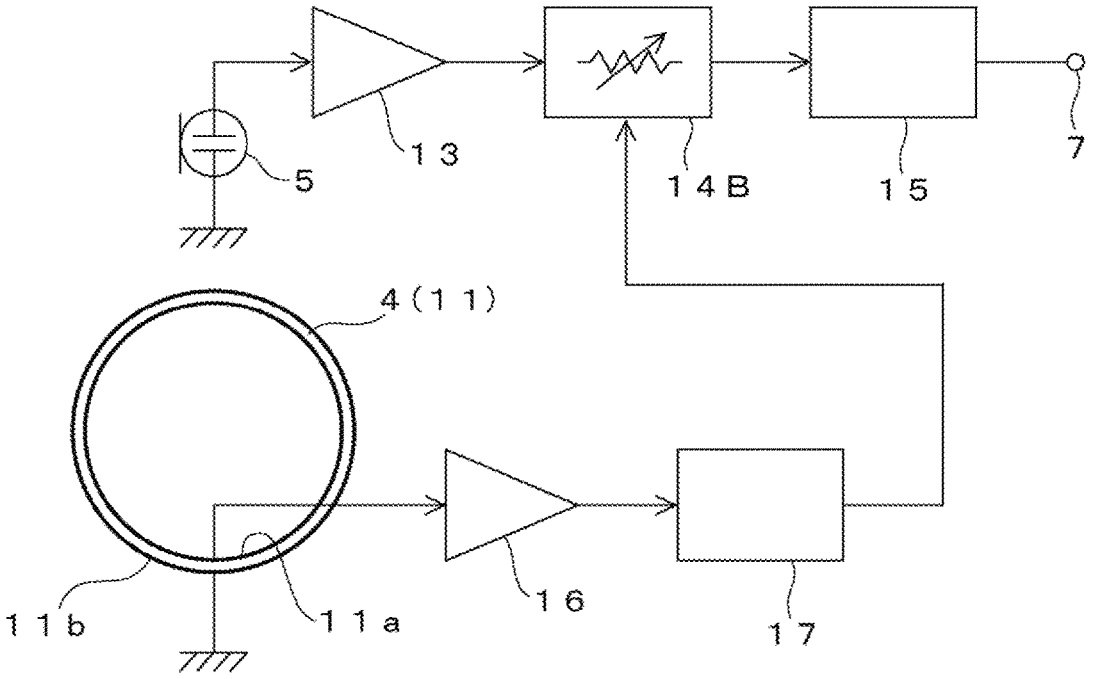
FIG. 3 is a block diagram of a narrow directional microphone according to a second embodiment of the present invention, and a signal processing unit mounted in the microphone.

Next, FIG. 3 is a block diagram illustrating an example of a narrow directional microphone according to a second embodiment and a signal processing unit mounted in the microphone.

An acoustic tube 4 in the microphone, as illustrated in FIG. 3, is wholly made of a piezoelectric film 11 in a tubular shape, and a detection output detected by the piezoelectric film 11 is taken out from an electrode 11*a* on an inner surface and an electrode 11*b* on an outer surface, both of which are formed in a tubular shape.

That is, the narrow directional microphone of the second embodiment uses the acoustic tube 4 wholly made of the piezoelectric film 11, in place of a combination of the acoustic tube 4 made of a resin and the piezoelectric film 11 which is stuck to the outer wall of the acoustic tube 4 along the axial direction illustrated in FIG. 1, and other parts of the entire narrow directional microphone are configured similar to the narrow directional microphone 1 illustrated in FIG. 1.

Note that a polyvinylidene fluoride (PVDF) resin described above can be favorably used for the piezoelectric film 11 that constitutes the acoustic tube 4 described in this example. Accordingly, the piezoelectric film 11 that forms the acoustic tube 4 constitutes a detection unit (referred to the same reference number as the piezoelectric film 11) that detects mechanical deformation of the acoustic tube 4.

Then, in the block diagram illustrating an output signal processing unit illustrated in FIG. 3, a basic configuration thereof is the same as the example illustrated in FIG. 2, and portions serving the same functions as the respective units described on the basis of FIG. 2 are illustrated with the same reference signs. Therefore, detailed description of the respective blocks is omitted.

Note that, in the example illustrated in FIG. 3, an attenuation circuit 14B with a resistive element in a signal level is included, in place of the low frequency range component attenuation circuit 14A with a low frequency cut filter illustrated in FIG. 2.

In the example illustrated in FIG. 3, when a value of a detection output by a second impedance conversion circuit 16 exceeds a predetermined threshold, a control circuit 17 functions to send a control signal to the attenuation circuit 14B with a resistive element, and to attenuate the level of the entire band of an audio signal from a first impedance conversion circuit 13 by a fixed amount.

With this configuration, both of a vibration noise and a wind noise output from a microphone unit 5 can be suppressed.

Further, in the example illustrated in FIG. 3, the control circuit 17 may be configured to vary an attenuation amount of the level of the entire band by the attenuation circuit 14B according to the value of the detection output by the second impedance conversion circuit 16 (a value of a detection output from the piezoelectric film 11), and a similar function and effect can be obtained.

In this case, it is desirable that the attenuation amount by the attenuation circuit 14B is set to increase as the level of the detection output by the second impedance conversion circuit 16 becomes higher, that is, the vibration noise and the wind noise become larger.

Note that the narrow directional microphone of the first embodiment according to the present invention uses the low frequency range component attenuation circuit 14A with a low frequency cut filter, as illustrated in FIG. 2, and the narrow directional microphone of the second embodiment uses the attenuation circuit 14B of a signal level with a resistive element, as illustrated in FIG. 3. However, even if the attenuation circuits 14A and 14B illustrated in FIGS. 2 and 3 are interchanged, the narrow directional microphone that can suppress both of the vibration noise and the wind noise can be provided.

What is claimed is:

1. A narrow directional microphone comprising:

a unit case having a front end portion to which a microphone unit is mounted, and a side surface functioning as a grip;

an acoustic tube, covering the microphone unit, and attached to the front end portion of the unit case such that the microphone unit is positioned to an inner bottom portion of the acoustic tube;

a detection unit that detects mechanical deformation of the acoustic tube; and an output signal processing unit including an attenuation circuit that attenuates an audio signal from the microphone unit in accordance with the detection output from the detection unit and sends the attenuated audio signal to a signal output unit.

2. The narrow directional microphone according to claim 1, wherein the detection unit is a piezoelectric film arranged on at least one part of the acoustic tube.

3. The narrow directional microphone according to claim 1, wherein the acoustic tube is formed of the piezoelectric film and the piezoelectric film constitutes the detection unit.

4. The narrow directional microphone according to claim 1, wherein the acoustic tube is flexible.

5. The narrow directional microphone according to claim 1, wherein the output signal processing unit includes the attenuation circuit with a low frequency cut filter that attenuates a low frequency range component in the audio signal from the microphone unit in accordance with the detection output.

6. The narrow directional microphone according to claim 5, wherein the low frequency cut filter varies a low cut off frequency, in accordance with a value of the detection output.

7. The narrow directional microphone according to claim 1, wherein the output signal processing unit includes the attenuation circuit that attenuates a level of the audio signal from the microphone unit in accordance with the detection output.

8. The narrow directional microphone according to claim 7, wherein the attenuation circuit attenuates the level of an entire band of the audio signal in accordance with a value of the detection output.

* * * * *